US012180021B2

(12) United States Patent
Unruh

(10) Patent No.: US 12,180,021 B2
(45) Date of Patent: Dec. 31, 2024

(54) METHOD FOR WINDING UP A WEB OF MATERIAL, IN PARTICULAR OF A COMPRESSIBLE MATERIAL AND AN APPARATUS FOR CARRYING OUT THE METHOD

(71) Applicant: SAINT-GOBAIN ISOVER, Courbevoie (FR)

(72) Inventor: Andreas Unruh, Neustadt (DE)

(73) Assignee: SAINT-GOBAIN ISOVER, Courbevoie (FR)

( * ) Notice: Subject to any disclaimer, the term of this patent is extended or adjusted under 35 U.S.C. 154(b) by 346 days.

(21) Appl. No.: 17/626,671

(22) PCT Filed: Jul. 21, 2020

(86) PCT No.: PCT/EP2020/070524
§ 371 (c)(1),
(2) Date: Jan. 12, 2022

(87) PCT Pub. No.: WO2021/013823
PCT Pub. Date: Jan. 28, 2021

(65) Prior Publication Data

US 2022/0411218 A1 Dec. 29, 2022

(30) Foreign Application Priority Data

Jul. 25, 2019 (DE) ..... 102019120122.5

(51) Int. Cl.
*B65H 18/26* (2006.01)
*B65H 18/22* (2006.01)

(52) U.S. Cl.
CPC ..... *B65H 18/26* (2013.01); *B65H 18/22* (2013.01); *B65H 2301/4138* (2013.01);
(Continued)

(58) Field of Classification Search
CPC ..... B65H 2511/166
See application file for complete search history.

(56) References Cited

U.S. PATENT DOCUMENTS 4,583,697 A * 4/1986 Bichot ..... B65H 18/16 242/534
11,691,838 B2 * 7/2023 Giurlani ..... B65H 23/005 242/418
2006/0267597 A1 11/2006 Sugiura

FOREIGN PATENT DOCUMENTS

DE 19904167 10/2000
DE 69800627 11/2001
(Continued)

OTHER PUBLICATIONS

Unruh, Andreas, Method for Winding up a Web of Material, in Particular of a Compressible Material and an Apparatus for Carrying out the Method, Japanese Patent Application Serial No. 2022-503913, filed Jul. 21, 2020, Office Action dated Mar. 15, 2023.
(Continued)

*Primary Examiner* — Sang K Kim
(74) *Attorney, Agent, or Firm* — Schmeiser, Olsen & Watts LLP

(57) ABSTRACT

The invention relates to a method for winding up a web of material with an apparatus including one winding-up space having a winding center; means for conveying and/or manipulating the web of material prior to and/or during winding-up; and including the following steps: operating the apparatus; monitoring the web of material and/or the resulting wound roll by means of at least one image capturing device for obtaining at least one current state of the web of material and/or of the wound roll; comparing at least one actual state to at least one target state and corresponding to the actual state, and determining at least one deviation of the actual state from the corresponding target state; if the
(Continued)

deviation exceeds/falls below at least one predetermined limit value, performing a correction of at least one operating parameter of the apparatus which operating parameter is at least a contributing factor for the deviation.

12 Claims, 6 Drawing Sheets

(52) U.S. Cl.
CPC .... *B65H 2511/15* (2013.01); *B65H 2511/166* (2013.01); *B65H 2553/42* (2013.01); *B65H 2701/177* (2013.01); *B65H 2701/18422* (2013.01); *B65H 2701/1846* (2013.01)

(56) References Cited

FOREIGN PATENT DOCUMENTS

| | | | | |
|---|---|---|---|---|
| DE | 102015112142 | | 1/2017 | |
| EA | 201170926 | | 12/2011 | |
| EP | 0949172 | | 10/1999 | |
| EP | 0993412 | | 4/2000 | |
| EP | 2319787 | | 5/2011 | |
| EP | 2837588 | | 2/2015 | |
| JP | 2000105104 | | 4/2000 | |
| JP | 2014213952 | | 11/2014 | |
| KR | 20000022358 | | 4/2000 | |
| WO | WO-03076320 | A1 * | 9/2003 | ..... B65H 18/16 |
| WO | 2006003258 | | 1/2006 | |

OTHER PUBLICATIONS

Unruh, Andreas, Method for Winding up a Web of Material, in Particular of a Compressible Material and an Apparatus for Carrying out the Method, Patent Cooperation Treaty Application Serial No. PCT/EP2020/070524, filed Jul. 21, 2020, International Search Report dated Oct. 13, 2020.

Wesely et al., Method and Device for Manufacturing a Pipe Shell From an Insulating Material, German Patent Application Serial No. 102019120122.5, filed Feb. 12, 2019, Search Report of German Intellectual Property Office dated Apr. 1, 2020.

Unruh, Andreas, Method for Winding up a Web of Material, in Particular of a Compressible Material and an Apparatus for Carrying out the Method, Patent Cooperation Treaty Application Serial No. PCT/EP2020/070524, filed Jul. 21, 2020, International Preliminary Report on Patentability dated Oct. 3, 2020.

Unruh, Andreas, Method for Winding up a Web of Material, in Particular of a Compressible Material and an Apparatus for Carrying out the Method, Russian Patent Application Serial No. 2022104758/10, filed Jul. 21, 2020, Office Action dated Aug. 19, 2022.

* cited by examiner

METHOD FOR WINDING UP A WEB OF MATERIAL, IN PARTICULAR OF A COMPRESSIBLE MATERIAL AND AN APPARATUS FOR CARRYING OUT THE METHOD

BACKGROUND OF THE INVENTION

The invention relates to a method for, in particular, the coreless winding-up of a web of material, in particular of a compressible material and an apparatus for carrying out the method.

SUMMARY OF THE INVENTION

An apparatus for rolling up compressible fibrous materials is known from DE 698 00 627 T2. Such an apparatus has a winding-up space in which a coreless wound roll is formed from the compressible fibrous material. The compressible fibrous material is provided in the form of webs and is moved toward the winding-up space by a first conveying means. Opposite the first conveying means and upstream of the winding-up space a pre-pressing device is provided by means of which the band-shaped fibrous material is compressible from a first thickness in conveying direction upstream of the pre-pressing device to a second (thinner) thickness downstream of the pre-pressing device. Furthermore, a second conveying means is provided which is arranged in tangential engagement against the winding-up roller and in an angle to the first conveying means. Furthermore, a restricting member, e.g., a roller, is provided, which, together with the two conveying means, forms the winding-up space. The restricting member is designed to be movable along a straight line (angle bisector of the conveying means) relative to the roll being formed and to be drivable by a motor. It is known from this publication that a distance D between the circumference of the roll to be wound up and the pre-pressing device is to be maintained substantially unchanged. To this end, the diameter of the wound roll is determined by means of suitable sensors and the pre-pressing device is displaced during the winding-up process according to the expanding wound roll such that the distance D remains as constant as possible. Such an apparatus does not allow for setting the distance D of the pre-pressing device depending on a winding quality of the wound roll.

Furthermore, an apparatus and a method for determining a distance measurement on wound-up materials is known from EP 2 328 746 B1. Here, a material wound onto a roll is illuminated by a light source, in particular a laser light source. A resulting height pattern on the web-type wound material is captured and analyzed by an image-capturing device (camera). Through evaluating a laser line, a step can be detected at the overlap of two windings and thus it can be determined whether an article is completely or not yet completely wrapped.

A method for producing a web of tissue material is known from DE 102 18 509 A1. With this method, a web of tissue material is guided through a press nip formed between a drying cylinder and an opposing unit. Downstream of the press nip, the web of tissue material is wound up by means of a winding-up device, wherein the hardness of the resulting roll can be influenced, in particular controlled and/or regulated, in a predeterminable manner. To control the line load in the winding nip, monitoring the winding nip area by means of a CCT camera is provided. Preferably, the distance between the carrier drum and the tambour or the roll formed thereon is captured. Monitoring the area of the winding nip in this way provides a means for checking and adjusting the winding force. By evaluating such an image, a target value for the pressure of the hydraulic cylinder affecting the displaceable wound roll can be reached.

The invention is concerned specifically, without being limited thereto, with winding up webs of fibrous insulating material, and more specifically with winding up webs of mineral wool nonwovens (glass wool and/or stone wool). In such a nonwoven, the fibers are present in a particular preferred direction and are bonded by a bonding agent. During winding-up, the nonwoven suffers unavoidable minor damage. For a consistent quality of the mineral wool nonwoven it is thus important that this damage remains as consistent as possible over the length of the web. The winding-up process must be controlled accordingly. Up until now, this is being done by the machine operator. He looks at the wound-up web and adjusts certain process parameters based on his experience.

It is the object of the present invention to provide a method for winding up a web of material by means of an apparatus which is particularly suited for compressible webs of material, in particular compressible webs of material made of fibrous material, e.g., webs of insulating material and the like. The method is intended to provide a quality-optimized winding result, wherein the method is intended to be automatically driven so that the method makes the active intervention of a machine operator practically unnecessary.

It is a further object of the present invention to provide an apparatus for carrying out the method.

According to the present invention, the object is solved by a method with the features according to claim 1. Advantageous embodiments are subject of the dependent method claims.

Furthermore, the object is solved by an apparatus having the features of claim 11. One advantageous embodiment is subject of claim 12.

A method according to the present invention for winding up a web of material by means of an apparatus having stationary and mobile devices, said apparatus having a winding-up space for accommodating an at least partially wound-up roll of material web (wound roll) having a winding center and means for conveying and/or for manipulating the web of material prior to and during winding-up, comprises the following steps:

- operating the apparatus;
- monitoring the web of material and/or the resulting wound roll by means of at least one image-capturing device for obtaining at least one current state (actual state) of the web of material and/or of the wound roll;
- comparing the at least one actual state to at least one corresponding target state and determining at least one deviation of the actual state from the target state;
- if the at least one deviation exceeds/falls below at least one predetermined threshold, performing a correction of at least one operating parameter of the apparatus, which operating parameter is at least a contributing factor for the deviation.

Preferably, the target state is stored in a database.

The method according to the invention allows for the improvement of the winding quality of a wound roll formed from, in particular, a compressible material, wherein in particular a consistent final diameter of the wound roll is achievable. Furthermore, a level of compression/compaction of the web of material is highly consistent over the entire length of the wound web. It is possible to ensure that a winding center of the wound web of material is to a large extent arranged centrically relative to the circumference of the wound roll. Last but not least, it is ensured that a circumference of the wound roll is to a large extent (except for a change in material thickness) (cf. FIG. 3) circular.

In a preferred embodiment of the method according to the present invention the monitoring is carried out such that

- a circumference of the wound roll about its winding center is detected and/or
- a web shape of the web of material is detected in a height direction before reaching the wound roll and/or
- a position of the winding center of the wound roll relative to the circumference of the wound roll is detected.

These measures make it particularly easy to detect incorrect winding or a developing winding quality tendency toward incorrect winding. By monitoring the circumference of the wound roll and/or a web form of the web of material, effective comparisons to target states can be carried out from which conclusions for modifying certain operating parameters can be drawn.

In another preferred embodiment, the monitoring of the web of material and the wound roll is carried out individually or cumulatively at the locations listed below:

- monitoring area A between a first conveying means and a second conveying means;
- monitoring area B between the second conveying means and a winding arm of a winding-up roller;
- monitoring area C between the winding-up roller and the first conveying means;
- wherein the monitoring areas A, B, C are disposed in the vicinity of the current circumference U of the wound roll.

The specified monitoring locations, i.e., the localized main monitoring areas, have proven particularly effective for detecting the circumference of the wound roll and a web form of the web of material.

In another preferred embodiment of the method, the comparing of the actual state to the target state is carried out by comparing actual circumferential contours to target circumferential contours of the wound roll and/or the web of material.

For a consistently good winding result, comparing the actual state to the target state based on the circumferential contours of the wound roll and/or the web of material is particularly helpful. These parameters have a direct influence on the winding quality.

In another preferred embodiment of the method according to the present invention, at least one operating parameter selected from the following operating parameters is corrected and/or adjusted to reduce the determined deviations:

- height h of a pre-pressing nip of a pre-pressing device;
- distance D of a free end edge of the pre-pressing bar from the circumference of the wound roll, which free end edge is facing in the conveying direction;
- a conveying speed $v_1$ of the first conveying means;
- a conveying speed $v_2$ of the second conveying means;
- a contact force F of the winding-up roller onto the circumference of the wound roll;
- an angle $\alpha$ between a first conveying direction of the first conveying means and a second conveying direction of the second conveying means;
- a movement curve of the winding arm;
- a circumferential speed of the winding-up roller;
- a third conveying speed $v_3$ of the pre-pressing device.

The specified operating parameters of the apparatus allow for counteracting an unintentional deviation between various actual and target states in a particularly effective manner.

In a further particular embodiment of the method according to the present invention, the monitoring, comparing and/or correcting are continuous.

The stated measures make it possible to detect an incipient deviation, which threatens to leave a tolerance range, at an early stage.

In a further particular embodiment of the method according to the present invention, an average value of multiple, chronologically successive actual states is used for the comparison.

Alternatively, an average value of multiple discrete actual states, i.e., in particular, discrete monitoring time points, may be used for the comparison. This helps to reduce the required computing power or to reduce the calculation time for a given computing power of a controller.

In a further particular embodiment of the present invention, the operating parameter is corrected/adjusted if:

- with continuous monitoring of the actual state, a deviation is detected over a minimum period of time and the deviation exceeds/falls below a limit value during said minimum period of time, or
- with intermittent monitoring, an average value of multiple deviations exceeds/falls below the corresponding limit value.

These measures provide two alternatives that are appropriate for classifying a deviation as relevant in order to avoid that a single actual state or short time window is assessed as a false positive for an exceedance/undercut of the limit value.

In a further particular embodiment of the present invention, monitoring the web of material and/or the resulting wound roll by means of at least one image-capturing device additionally comprises monitoring at least part of the apparatus, in particular at least part of the mobile devices.

This measure, which is to be carried out in addition to feature b) of claim 1, can be used to make better predictions of errors regarding the winding result and/or to check adjustments or modifications made to the apparatus or its stationary and/or mobile devices and to monitor and, if necessary, analyze their effects on winding quality.

Furthermore, the object of the present invention is solved by an apparatus for carrying out the above-named method, said apparatus having:

- a winding-up space for accommodating an at least partially wound-up roll of material web (wound roll) having a winding center;
- means for conveying and/or manipulating the web of material prior to and/or during winding-up;
- at least one image-capturing device for monitoring the web of material and/or the wound roll;
- at least one analyzing unit comparing image information of actual states to stored target states and determining deviations;
- at least one correcting unit for correcting at least one operating parameter of the apparatus;
- means for setting the at least one corrected operating parameter on the apparatus.

This apparatus provides a simple means for carrying out the method. In particular, only few hardware monitoring means are required. In the simplest case, an inexpensive digital camera and a computing device are sufficient.

A preferred embodiment of the apparatus according to the present invention has a memory at least for storing image data regarding target states of the apparatus or the wound roll.

In a particular embodiment, the apparatus itself has a memory for such target states. Alternatively, such a memory may also be provided outside of the apparatus.

BRIEF DESCRIPTION OF THE DRAWINGS

In the following, the invention is explained in more detail by way of examples with reference to the drawing. The figures show.

DETAILED DESCRIPTION OF EMBODIMENTS OF THE INVENTION

Figure 1:
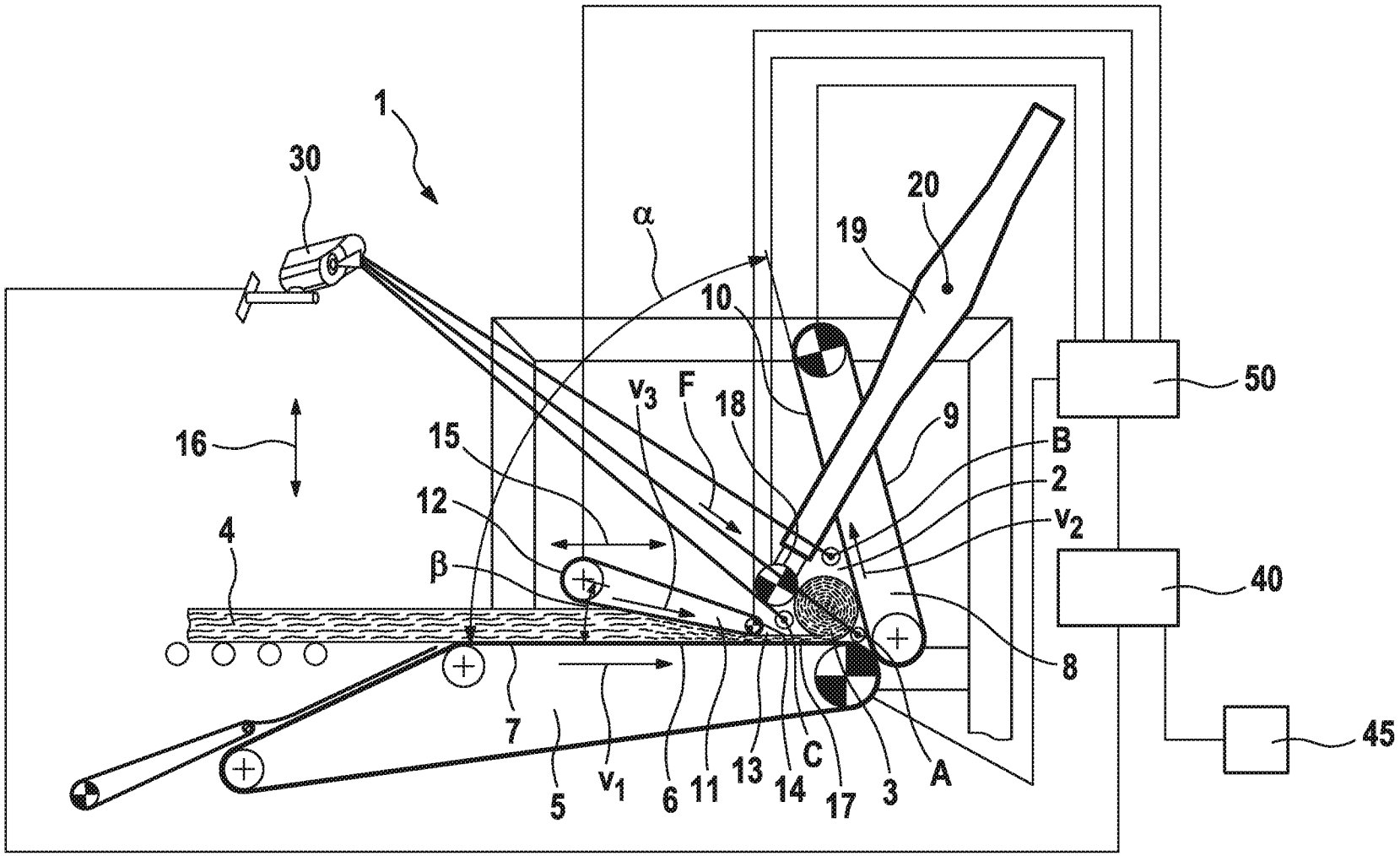
FIG. 1: a schematic side view of an apparatus for carrying out the method according to the invention.

To explain the method according to the present invention for winding up a web of material by means of an apparatus, first the apparatus for carrying out the method will be explained in more detail using FIG. 1 as an example.

An apparatus 1 for carrying out the method according to the invention has an open winding-up space 2 for accommodating a wound-up roll of material web (wound roll 3). The wound roll 3 is, in particular, wound up coreless, i.e., the wound roll 3 does not contain any rigid body around which the web of material 4 to be wound up is wound up.

The apparatus 1 further comprises means for conveying and/or for manipulating the web of material 4, said means mechanically acting on the web of material 4 prior to and during winding-up or on the resulting wound roll 3. For this purpose, the apparatus 1 comprises a first conveying means 5 which is, in particular, formed as a belt conveyor having a conveyor belt 6. In the conveying state, the web of material 4 is placed on a loaded side 7 of the conveyor belt 6 with the loaded side 7 moving in the depicted direction of the arrow (conveying direction) with a conveying speed v1.

A second conveying means 8 is also configured as a belt conveyor having a conveyor belt 9. A loaded side 10 of the second conveying means 8 moves in the depicted direction of the arrow (conveying direction) with a conveying speed v2. In a side view, the first loaded side 6 and the second loaded side 10 form an angle α to each other and each encloses a part of the winding-up space 2.

Positioned upstream of the winding-up space 2 in the conveying direction (direction of speed v1) of the web of material 4, the apparatus 1 has a pre-pressing device 11. The pre-pressing device 11 has a belt conveyor 12 and a pre-pressing bar 13. The pre-pressing bar 13 has a free end edge 14, which faces towards wound roll 3. The free end edge 14 is displaceable in an X-direction (double arrow 15) and in a Z-direction (double arrow 16) relative to the winding-up space and the loaded side 7 of the first conveying means, respectively. In particular, the displacement may be adapted to be motor-drivable.

Moreover, an angle β between the belt conveyor 12 of the pre-pressing device 11 and the loaded side 7 of the first conveying means is adjustable, in particular, adjustable by means of a motor.

The displacement of the pre-pressing device 11 in the direction of the double arrow 16 results in a height h of a pre-pressing nip 17 (cf. FIG. 2*a*) between the pre-pressing bar 13 and the conveyor belt 6 of the first conveying means 5.

Moreover, the apparatus 1 comprises a motor-driven winding-up roller 18, the axis of rotation of which is disposed approximately on the angle bisector of angle α. The winding-up roller 18 is attached to a winding arm 19, which is pivotably arranged about a pivot axis 20 and is arranged to be, in particular, adjustable by a motor.

The conveying means 5, 8 are stationary in the double-arrow directions 15, 16 during the winding process. If required, the angle α between the loaded sides 7 and 10 is variably adjustable and, if applicable, adjustable by a motor. The pivot axis 20 is movable in the direction of double arrow 16. The winding-up roller 18 is motor-drivable about its axis and arranged such that said winding-up roller in contact with a circumference U of the wound roll 3 of the web of material 4 already wound up and is pivotable about the axis 20 with the expanding wound roll 3. The contact pressure (force F) of the winding-up roller 18 onto the circumference of the wound roll 3 is adjustable by means of the winding arm 19. The first loaded side 7, the second loaded side 10 and the winding-up roller 18 define the winding-up space 2 for the wound roll 3 being formed.

For evaluating the winding quality of the wound-up wound roll 3, monitoring areas in the vicinity of the wound roll 3 in particular are of great interest. These monitoring areas are marked with the letters A, B, C in the figures. By monitoring these monitoring areas A, B, C, substantiated statements about the winding quality of the wound roll 3 can be made.

The web of material 4 is, for example, a web of material made of fibrous, compressible material such as a web of insulating fibrous material. Nevertheless, all webs of material that are compressible in a thickness direction can be processed with the apparatus according to the present invention.

According to the present invention, the apparatus 1 has at least one image-capturing device 30 arranged in the space and aligned in regard to its line of sight such that in particular the monitoring areas A, B, C can be monitored. The image-capturing device 30 may be, for example, a CCD camera or any other image-capturing device 30 that preferably provides electronic image data.

Furthermore, the at least one image-capturing device 30 may be aligned so as to monitor additional or alternative portions of the apparatus outside of the monitoring areas A, B, C.

The above mentioned additional or alternatively performed monitoring of portions of the apparatus outside of the monitoring areas A, B, C, serves to carry out any apparatus-specific monitoring measures, for example, whether an automatically adjusted correction of a parameter has actually been set.

It should be emphasized that in order to solve the object of the present invention, only a monitoring the web of material and/or the resulting wound roll according to feature b) of claim 1 is required. An additional monitoring of the apparatus itself may be a preferred embodiment of the present invention. In particular, individual devices of the apparatus such as stationary and mobile devices of the apparatus that have an effect on the web of material and/or the wound roll being formed or that interact with the web of material and/or the wound roll being formed, may be monitored. Such additional monitoring of the apparatus itself or of individual devices of the apparatus, which is expedient but not essential for achieving the invention, may take place in addition to monitoring the web of material and/or the wound roll being formed according to feature b), so that the inventive effect is achieved when either the web of material and/or the wound roll being formed, or the web of material and/or the wound roll being formed and the apparatus or the devices of said apparatus are being monitored.

The image-capturing device 30 is connected to at least one analyzing unit 40 which compares image information of actual states of the wound roll 3 to stored target states of the wound roll 3 and determines deviations between these states. For the purpose of storing target states, the apparatus 1 expediently has a memory 45 which holds necessary data regarding target states and provides said data to the analyzing unit 40, when necessary.

In addition, the apparatus has at least one correcting unit 50 which determines from the deviations determined by the analyzing unit 40 necessary corrections of at least one operating parameter of the apparatus 1. The correcting unit 50 causes means for setting the at least one corresponding operating parameter on the apparatus to modify the associated operating parameter. Possible operating parameters may be:

- a distance D (cf. FIG. 2*a*) of the free end edge 14 of the pre-pressing bar 13 from the infeed area 21 of the wound roll 3 or the height h, which free end edge faces in the conveying direction (direction of speed $v_1$);
- the speed levels $v_1$, $v_2$;
- a contact force F of the winding-up roller 18 onto the circumference U of the wound roll 3;
- the circumferential speed with which the winding-up roller 18 is driven;
- the third conveying speed $v_3$ of the belt conveyor 12;
- the movement curve of the winding arm 19 about the pivot axis 20;
- the angle $\alpha$ between the first conveying means 5 and the second conveying means 8.

Relationships, in particular cause-effect relationships, correlations and/or causalities between occurring deviations of the actual states from the target states of the wound roll 3 and the operating parameters are stored as information of a knowledge database in the memory 45.

Relationships between the operating parameters and the actual states of the wound roll 3 are explained below using FIGS. 2*a* to 6 as examples, but not exhaustively, based on selected parameters.

Figure 2A:
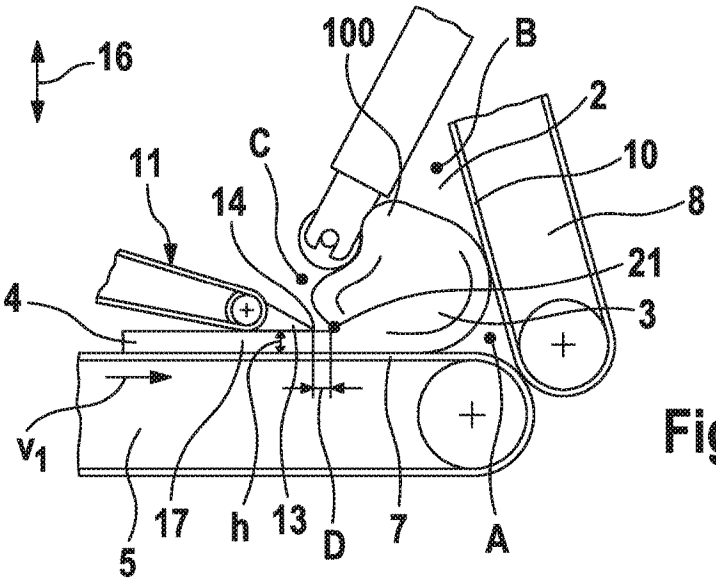
FIGS. 2*a*-2*c*: defective states (FIG. 2*a*, 2*b*) and a non-defective state (FIG. 2*c*) of a wound roll and a web of material prior to being wound up onto the wound roll, respectively.

FIG. 2*a* shows the pre-pressing nip 17 as well as its height h. Partially shown are the first conveying means 5 with the first loaded side 7 on which the web of material 4 is fed with the conveying speed v1.

Furthermore, the second conveying means 8 with the second loaded side 10 is partially shown.

Further shown are the pre-pressing device 11 with the pre-pressing bar 13, the free end edge 14 of which having a certain distance D from the infeed area 21 of the web of material 4 into a circumferential web of the wound roll 3. Bulges 100 of the wound roll 3 deviating from a cylinder shape are noticeable in the area of the winding-up roller 18. Such a defect characteristic occurs, for example, if the movement curve of the winding arm 19 is selected with an opening speed that is too low for the specific web of material 4 to be wound up. One cause for this can be an incorrectly selected, excessive height h of the pre-pressing nip. Such a defect characteristic (bulges 100) can be detected by the image-capturing device 30 (monitoring of areas B and C).

The bulges 100 are created by an insufficient pre-pressing of the compressible web of material 4 by the pre-pressing device 11, resulting in an excessive diameter increase of the roll per winding. Such an excessive diameter manifests in the bulges 100 in the vicinity of the winding-up roller 18.

Figure 2B:
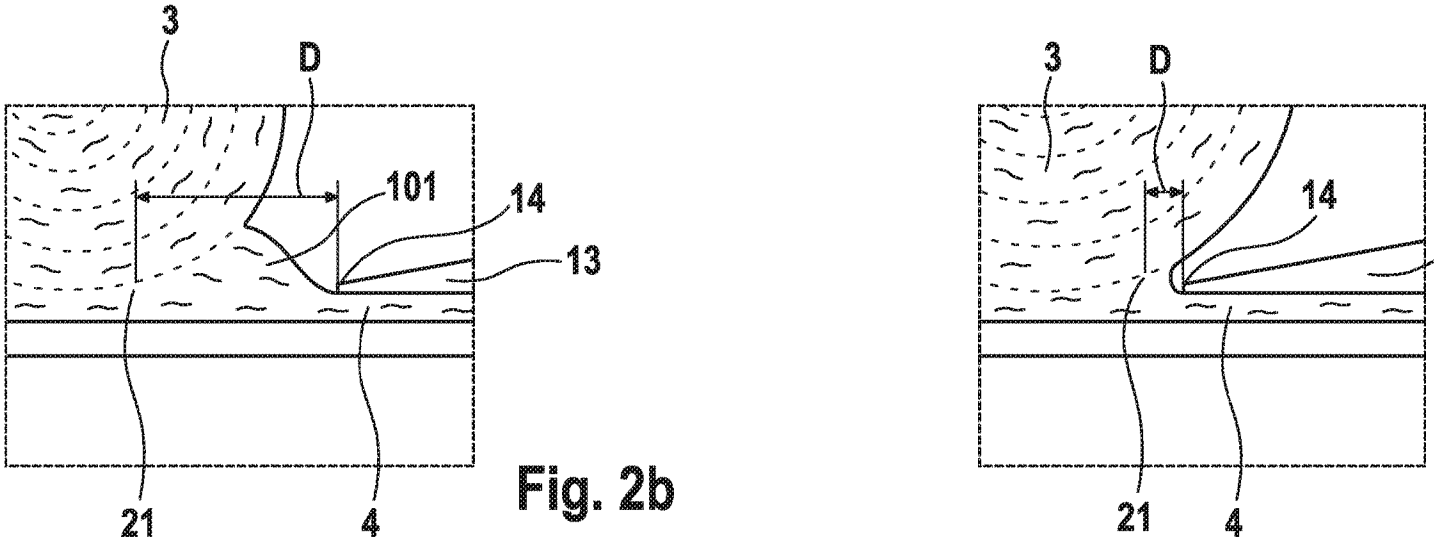

FIG. 2*b* shows another bulge 101 in an area between the free end edge 14 of the pre-pressing bar 13 and the infeed area 21 of the web of material 4 into the wound roll 3. Such a defect characteristic appears with an excessive distance D between the free end edge 14 and the infeed area 21.

Figure 2C:
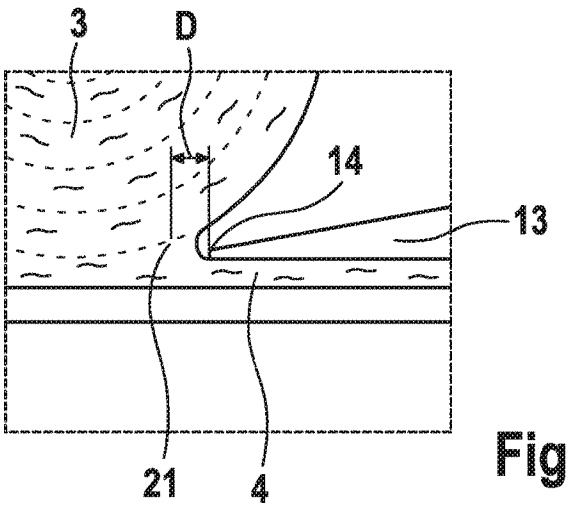

FIG. 2*c* shows a corrected state of FIG. 2*b*, with the corrected state no longer having a bulge 101. The distance D between the infeed area 21 and the free end edge 14 is considerably smaller compared to the distance D in FIG. 2*b*.

Figure 3B:
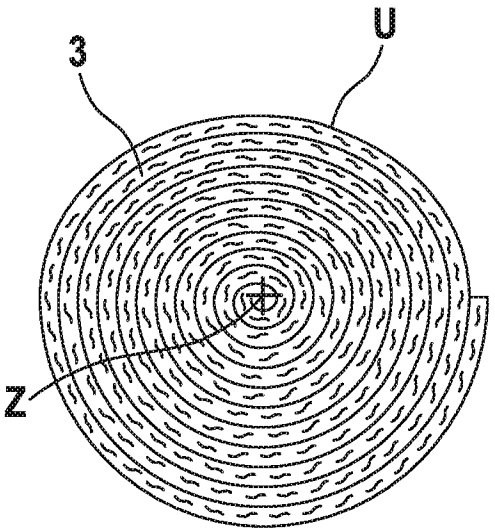
FIGS. 3*a*, 3*b*: a target state of a wound roll (FIG. 3*b*) and a first undesirable state of deviation of a wound roll (FIG. 3*a*) having an eccentrically disposed winding center Z.
Figure 3A:
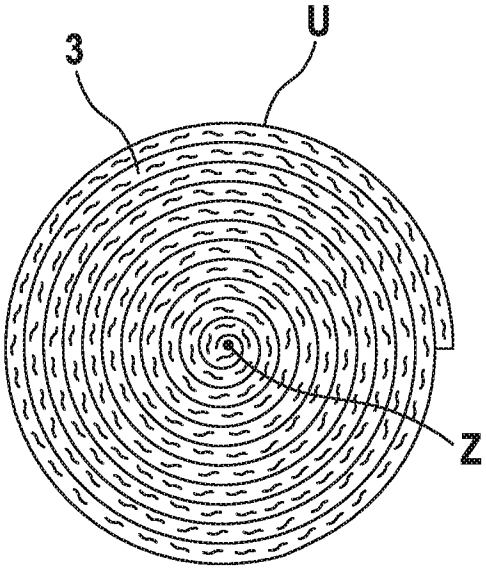

FIG. 3*a* shows an ideal wound roll 3 with a winding center Z arranged centrically relative to the circumference U of the wound roll 3.

FIG. 3*b* shows a possibly occurring defect characteristic of the wound roll 3, in which the winding center Z is shifted eccentrically upwards relative to the circumference U of the wound roll (in the view according to FIG. 3*b*). Furthermore, in the roll portion above the center Z, the windings, i.e., the winding layers of the wound roll 3, are more compressed and have a thinner thickness then in the area below the winding center Z.

Correcting the variable wall thicknesses of all windings and the correct arrangement of the winding center Z in the center of the wound roll 3 associated therewith is directly dependent on the pivot position of the winding arm 19. A contact pressure of the winding-up roller 18 can be directly influenced by pivoting the winding arm, which is motor-drivable about the pivot axis 20. The pivotal displacement of the winding arm 19 about the pivot axis 20 and its extent, e.g., per rotation of the wound roll 3, affects the local thickness of the web of material and thus the position of the winding center Z. By influencing the movement curve of the winding arm 19 through adjusting respective operating parameters, such a defect characteristic can be addressed, should it occur.

Figure 4A:
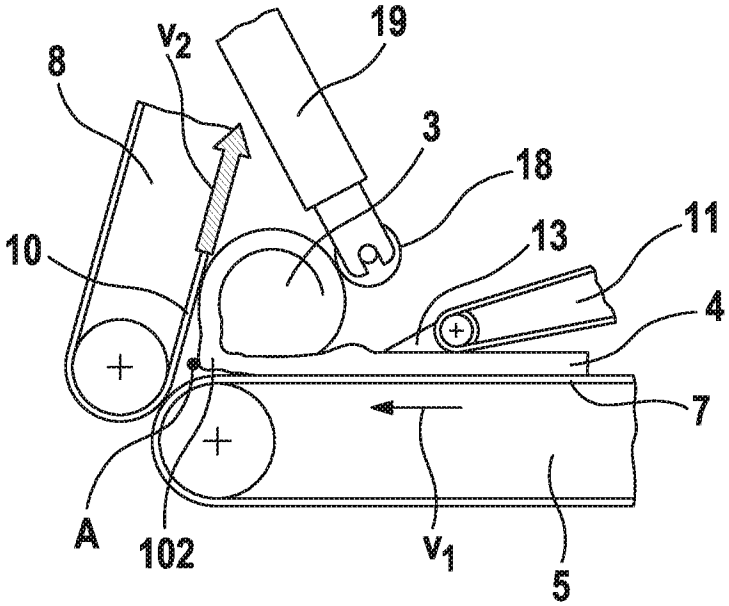
FIG. 4*a*: a defect characteristic of the wound roll with an insufficient conveying speed v2 of the second conveying means.

FIG. 4*a* shows a defect characteristic of the wound roll 3 in the area of the monitoring area A. Here, an undesirable bulge 102 is forming into the monitoring area A. The reason for such a deviation is, for example, an insufficient conveying speed v2 of the loaded side 10 of the second conveying means 8.

Figure 4B:
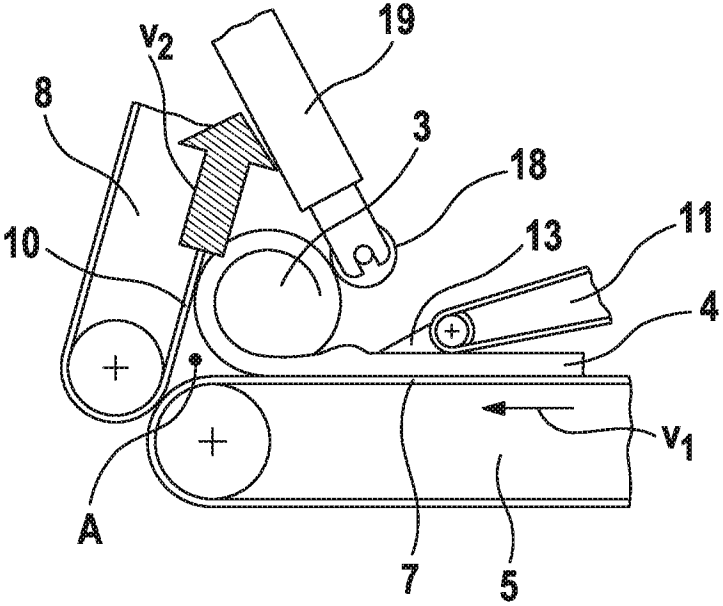
FIG. 4*b*: a target state of the wound roll with a correct conveying v2 speed of the second conveying means.

The bulge 102 can be avoided by increasing the conveying speed v2 (thicker arrow), as can be taken from FIG. 4*b*. Thus, when a defect characteristic according to FIG. 4*a* occurs, the apparatus according to the present invention ensures a correct winding-up by increasing the operating parameter v2.

Figure 5A:
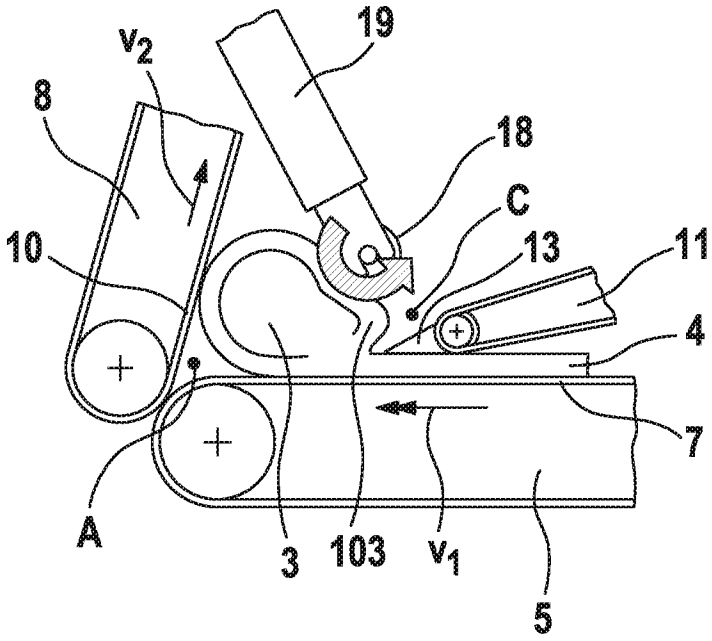
FIG. 5*a*: a defect characteristic of the wound roll with an excessive rotational speed of a winding-up roller.

Another possible defect characteristic, i.e., a possible deviation of the actual state of the wound roll 3 from a target state, is shown in FIG. 5*a*. In the monitoring area C, an undesirable bulge 103 occurs. Such an undesirable bulge 103 is caused by an excessive drive speed (thick curved arrow) of the winding-up roller 18.

Figure 5B:
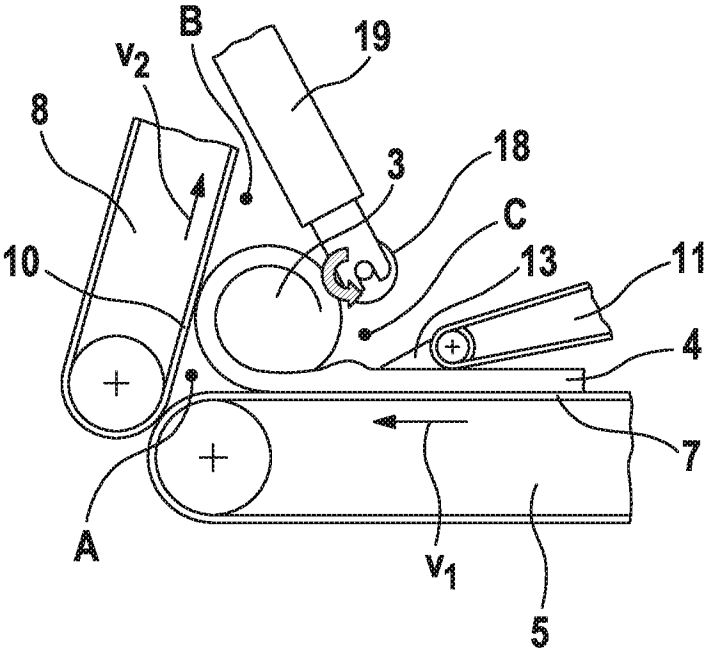
FIG. 5*b*: a target state of the wound roll with a correct rotational speed of the winding-up roller.

FIG. 5*b* shows a corrected state, in which a bulge 103 no longer occurs in the monitoring area C, as is desired. The rotational speed of the winding-up roller 18 (thin arrow) has been reduced accordingly.

Figure 6:
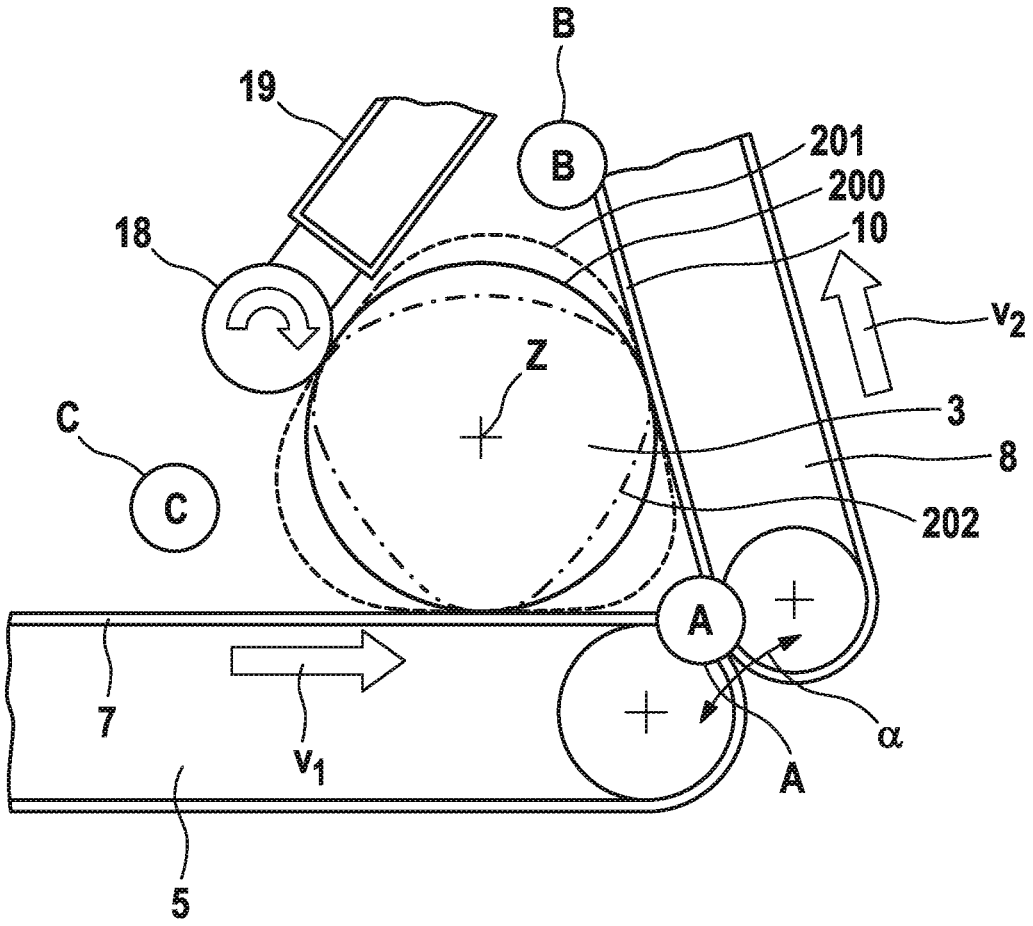
FIG. 6: preferred monitoring areas for monitoring the contour of the wound roll.

FIG. 6 shows in an overview an ideal contour 200 of the wound roll 3 (solid line) and a first state of deviation 201 of the circumference of the wound roll (dashed line). The first state of deviation 201 is characterized by diameter increases/contour changes of the wound roll 3 outwardly into the monitoring areas A, B, C.

A second state of deviation 202 is indicated by the dot-dashed line in FIG. 6, in which the circumference in each of the monitoring areas A, B, C, is too small.

In the following, the method according to the present invention will be described in greater detail based on the apparatus according to FIG. 1.

The method according to the present invention comprises, in particular, the steps:

a) operating an apparatus, in particular an apparatus 1 according to FIG. 1;

b) monitoring the web of material 4 and/or the resulting wound roll 3 by means of at least one image-capturing device 30 for obtaining at least one actual state of the wound roll 3.

Corresponding target states (desired states) of the wound roll 3 being formed are known for particular stages of the winding process. These target states are preferably stored in a database, in particular in a memory 45. The actual states captured by the image-capturing device 30 are compared to corresponding target states, i.e., with the chronologically corresponding target states, e.g., a state in which the roll has a particular number X of windings. If deviations exceeding a particular tolerance are detected, then selected operating parameters of the apparatus 1 are influenced by means of a correcting unit 50. The selection of the respective operating parameter and the direction and the amount of modification of this operating parameter (speed, angle, contact pressure, arrangement in the space) are corrected accordingly. Here it is possible that an incorrectly set operating parameter can be clearly attributed to a defect characteristic. It is, however, also possible that multiple incorrect operating parameters can lead to a particular defect characteristic and these are then modified according to the findings in the knowledge database in the memory 45.

With the method according to the present invention and/or the apparatus according to the present invention for carrying out said method, the occurrence of known deviations of actual states from target states of the wound roll 3 can be detected and automatically corrected through modified operation of the apparatus 1. A correcting intervention by a machine operator is thus no longer necessary.

Furthermore, the method according to the present invention has the particular advantage that the monitoring can be continuous or in short intervals so that immediate action is possible when a winding error (deviation too large) occurs and a winding reject can be avoided.

The invention claimed is:

1. A method for winding up a web of mineral wool nonwovens into a wound roll comprising:

a winding-up space for accommodating an at least partially wound roll having a winding center; and a conveying apparatus for conveying and/or manipulating the web of mineral wool nonwovens prior to and/or during winding-up the at least partially wound roll comprising the steps of:

a) operating the conveying apparatus;

b) monitoring the web of mineral wool nonwovens and/or the at least partially wound roll by at least one image-capturing device for obtaining at least one current actual state of the web of mineral wool nonwovens and/or of the at least partially wound roll;

c) comparing a first image and/or first image data of the at least one current actual state of the web of mineral wool nonwovens and/or the at least partially wound roll to a second image and/or second image data of at least one target state of the web of mineral wool nonwovens and/or the at least partially wound roll corresponding to the at least one current actual state, and determining at least one deviation of the at least one current actual state from the corresponding at least one target state; and d) determining the at least one deviation as compared to at least one predetermined limit value, performing a correction of at least one operating parameter of the conveying apparatus when the at least one deviation is determined, the at least one operating parameter being at least a contribution factor for the at least one deviation.

2. The method according to claim 1, wherein the at least one target state is stored in a data base.

3. The method according to claim 1, wherein the monitoring is carried out such that a circumference of the at least partially wound roll about the winding center is detected and/or a web form of the web of mineral wool nonwovens is detected in a height direction before reaching the at least partially wound roll and/or a position of the winding center of the at least partially wound roll relative to the circumference of the at least partially wound roll is detected.

4. The method according to claim 1, wherein the monitoring of the web of mineral wool nonwovens and/or the at least partially wound roll is carried out by monitoring a first monitoring area between a first conveyor and a second conveyor;

monitoring a second monitoring area between the second conveyor and a winding arm supporting a winding-up roller; and/or monitoring a third monitoring area between the winding-up roller and the first conveyor, and wherein the first, second and/or third monitoring areas are disposed about a circumference of the at least partially wound roll.

5. The method according to claim 1, wherein the comparing of the at least one current actual state to the at least one target state is carried out by comparing current actual circumferential contours to target circumferential contours of the at least partially wound roll and/or the web of mineral wool nonwovens.

6. The method according to claim 1, wherein the at least one operating parameter is selected from the group consisting of:

height of a pre-pressing nip of a pre-pressing device;

distance of a free end edge of a pre-pressing bar from the circumference of the at least partially wound roll, the free end edge facing in a conveying direction;

a first conveying speed of the first conveyor;

a second conveying speed of the second conveyor;

a contact force of the winding-up roller onto the circumference of the at least partially wound roll;

an angle between a first conveying direction of the first conveyor and a second conveying direction of the second conveyor;

a movement curve of the winding arm;

a circumferential speed of the winding-up roller; and/or a third conveying speed of the pre-pressing device.

7. The method according to claim 1, wherein the monitoring, the comparing and/or the correcting are carried out continuously.

8. The method according to claim 7, wherein an average value of several, chronologically successive of the current actual states is used for the comparison.

9. The method according to claim 1, wherein the at least one operating parameter is corrected when:

a) with continuous monitoring of the current actual state, the at least one deviation is detected over a minimum period of time and the at least one deviation exceeds or falls below a limit value during said minimum period of time, or b) with intermittent monitoring of the current actual state an average value of multiple deviations exceeds or falls below the corresponding limit value.

10. The method according to claim 1, wherein the monitoring the web of mineral wool nonwovens and/or the at least partially wound roll by the at least one image-capturing device comprises monitoring at least part of the conveying apparatus.

11. An apparatus for carrying out the method according to claim 1 comprising:

the at least one image-capturing device for monitoring the web of mineral wool nonwovens and/or the at least partially wound roll;

at least one analyzing unit comparing image information of the current actual states to stored target states and determining the at least one deviation; and at least one correcting unit for correcting at least one operating parameter of the conveying apparatus;

wherein the at least one corrected operating parameter is set by the at least one correcting unit.

12. The apparatus of claim 11, wherein a memory is provided for storing the first and second image and/or image data regarding the at least one target state of the at least partially wound roll.

* * * * *